US010333203B2

(12) United States Patent
Collignon

(10) Patent No.: US 10,333,203 B2
(45) Date of Patent: Jun. 25, 2019

(54) POLARISATION DEVICE FOR A SATELLITE TELECOMMUNICATIONS ANTENNA AND ASSOCIATED ANTENNA

(71) Applicant: INEO DEFENSE, Velizy Villacoublay (FR)

(72) Inventor: Gerard Collignon, Orsay (FR)

(73) Assignee: INEO DEFENSE, Velizy Villacoublay (FR)

( * ) Notice: Subject to any disclaimer, the term of this patent is extended or adjusted under 35 U.S.C. 154(b) by 488 days.

(21) Appl. No.: 14/901,448

(22) PCT Filed: May 20, 2014

(86) PCT No.: PCT/EP2014/060339

§ 371 (c)(1),
(2) Date: Dec. 28, 2015

(87) PCT Pub. No.: WO2014/206649

PCT Pub. Date: Dec. 31, 2014

(65) Prior Publication Data

US 2016/0372820 A1 Dec. 22, 2016

(30) Foreign Application Priority Data

Jun. 27, 2013 (FR) ..... 13 56168

(51) Int. Cl.
*H01Q 1/28* (2006.01)
*H01Q 15/00* (2006.01)
(Continued)

(52) U.S. Cl.
CPC ..... *H01Q 1/288* (2013.01); *H01Q 1/38* (2013.01); *H01Q 15/006* (2013.01); *H01Q 15/0026* (2013.01); *H01Q 15/244* (2013.01)

(58) Field of Classification Search
CPC ..... H01Q 15/0026; H01Q 15/006; H01Q 15/244; H01Q 1/288; H01Q 1/38
See application file for complete search history.

(56) References Cited

U.S. PATENT DOCUMENTS 5,793,330 A 8/1998 Gans et al.
6,285,323 B1 * 9/2001 Frank ..... H01Q 21/0006 343/700 MS (Continued)

FOREIGN PATENT DOCUMENTS

EP 2 469 653 A1 6/2012
EP 2469653 A1 * 6/2012 ..... H01Q 15/244

OTHER PUBLICATIONS

International Search Report, dated Jul. 9, 2014, from corresponding PCT Application.

*Primary Examiner* — Jessica Han
*Assistant Examiner* — Jae K Kim
(74) *Attorney, Agent, or Firm* — Young & Thompson

(57) ABSTRACT

The present invention relates to a polarization device (10) for a satellite telecommunications antenna (11) including at least one frequency selective layer (12) able to convert a linear polarization (E), including two components (Ex, Ey), into left circular polarization in a first transmission frequency band (Tx) and into right circular polarization in a second receiving frequency band (Rx) or vice versa, the phase shift between the two components (Ex, Ey) of the linear polarization (E) being included between −85 and −95 degrees, preferably −90 degrees in one of the frequency bands (Rx, Tx), and the phase shift between the two components (Ex, Ey) of the linear polarization (E) being included between +85 and +95 degrees, preferably +90 degrees in the other frequency band (Rx, Tx).

18 Claims, 4 Drawing Sheets

(51) Int. Cl.
*H01Q 15/24* (2006.01)
*H01Q 1/38* (2006.01)

(56) References Cited

U.S. PATENT DOCUMENTS

| | | | | |
|---|---|---|---|---|
| 7,683,444 | B2 * | 3/2010 | Tonucci | G02F 1/015 250/336.1 |
| 2006/0170596 | A1 * | 8/2006 | Habib | H01Q 1/38 343/700 MS |
| 2007/0215843 | A1 * | 9/2007 | Soukoulis | B82Y 20/00 252/570 |
| 2008/0165079 | A1 * | 7/2008 | Smith | B82Y 20/00 343/911 R |
| 2008/0212921 | A1 * | 9/2008 | Gaylord | B82Y 20/00 385/14 |
| 2010/0019868 | A1 * | 1/2010 | Hyde | H01P 7/08 333/219 |
| 2010/0295739 | A1 * | 11/2010 | Wu | H01Q 15/10 343/702 |
| 2014/0085711 | A1 * | 3/2014 | Sonkusale | H01P 7/082 359/350 |

* cited by examiner

POLARISATION DEVICE FOR A SATELLITE TELECOMMUNICATIONS ANTENNA AND ASSOCIATED ANTENNA

FIELD OF THE INVENTION

The present invention relates to the field of polarizers for satellite telecommunications antennae. The invention also relates to an associated satellite telecommunications antenna.

The invention is in particular advantageously applicable to the emission and reception of data to or from a satellite especially for satcom (acronym of satellite communications) type satellite telecommunications.

PRIOR ART

Satellite telecommunications conventionally use an emission frequency band Tx and a reception frequency band Rx. The emission and reception polarizations are often both circular but of opposite handedness, especially for certain satellites working in the X, Ka and Q/V bands.

The use of circular polarization is particularly well adapted to communications between a moving platform (terrestrial vehicle, naval vessel, plane, etc.) and a satellite because, in contrast to linear polarization, it is not necessary to orient the polarization.

Production of a panel array antenna for this application therefore requires the use of dual-band (band Rx and band Tx) and dual-polarization (left-hand circular and right-hand circular) radiating elements. The polarization direction is preferably switchable.

Radiating elements (patches, dipoles, etc.) are, most often, dual linearly polarized and the circular polarization is obtained by means of a 90° hybrid coupler (or equivalent) associated with each element or each row of radiating elements if the antenna is an active or electronically scanned antenna. The main drawback of this structure arises from the fact that the distribution of power to the N radiating elements requires the use of two splitters at one input and N outputs. Namely, one splitter for the emission and one splitter for the reception i.e. one splitter for each of the two orthogonal linear polarizations.

SUMMARY OF THE INVENTION

The present invention is intended to remedy the drawbacks of the prior art by providing a polarizing device allowing a satellite telecommunications antenna equipped with radiating elements having a single linear polarization, and therefore a single splitter and a single access for the Rx and Tx bands, to be used. The two circular polarizations are produced in free space in front of the antenna by means of a polarizer that converts the linear polarization into a left-hand circular polarization in the frequency band Tx and into a right-hand circular polarization in the frequency band Rx, or vice versa.

For this purpose, the present invention relates, according to a first aspect, to a polarizing device for a satellite telecommunications antenna, including at least one frequency-selective layer able to convert a linear polarization, comprising two components, into a left-handed circular polarization in an emission first frequency band and into a right-handed circular polarization in a reception second frequency band or vice versa, the phase shift between the two components of the linear polarization being comprised between −85 and −95 degrees, and preferably being −90 degrees, in one of the frequency bands, and the phase shift between the two components of the linear polarization being comprised between +85 and +95 degrees, and preferably being +90 degrees, in the other of the frequency bands.

The invention allows the complexity of the radiating elements and splitters of a satellite telecommunications antenna to be decreased and thus its production to be facilitated. Furthermore, the invention also allows the bulk of a satellite telecommunications antenna to be limited, facilitating its installation on a moving platform. Conventionally, the emission and reception frequencies are separated by filtering by means of a diplexer.

According to one embodiment, the device includes a plurality of frequency-selective layers of identical patterns. As a variant, the pattern may be different between the various layers.

According to one embodiment, the at least one frequency-selective layer is produced on a printed circuit board having a substrate thickness of 2 mm and a relative dielectric constant equal to 2.2. For example, the substrate selected is an RT/duroid 5880 laminate.

According to one embodiment, the device includes four frequency-selective layers.

According to one embodiment, the device has a susceptance corresponding to the following equation:

$$B = \frac{B_2}{\left(1 - \left(\frac{F}{F_0}\right)^2\right)}$$

in which a characteristic makes it possible to adjust the slope about a cut-off frequency as a function of frequency.

According to one embodiment, the device has a susceptance corresponding to the following equation:

$$B = B_1\left(1 - \left(\frac{F}{F_0}\right)^2\right)$$

in which a characteristic makes it possible to adjust the slope about a cut-off frequency as a function of frequency.

According to one embodiment, the device includes at least one dielectric layer. This embodiment makes it possible to improve the coupling of the polarizing device.

According to a second aspect, the invention relates to a satellite telecommunications antenna including a polarizing device according to the first aspect of the invention.

According to one embodiment the antenna is a panel antenna. The polarizing device is particularly well adapted to a panel antenna as it is small in bulk, but it may also be used in any other type of antenna. Preferably, the panel antenna consists of a network of patch radiating elements formed from a conductive material, or of dipoles or equivalent.

BRIEF DESCRIPTION OF THE DRAWINGS

The invention will be better understood by virtue of the description, which is given below purely by way of illustration, of embodiments of the invention, and with reference to the figures, in which.

DETAILED DESCRIPTION OF EMBODIMENTS OF THE INVENTION

Figure 1:
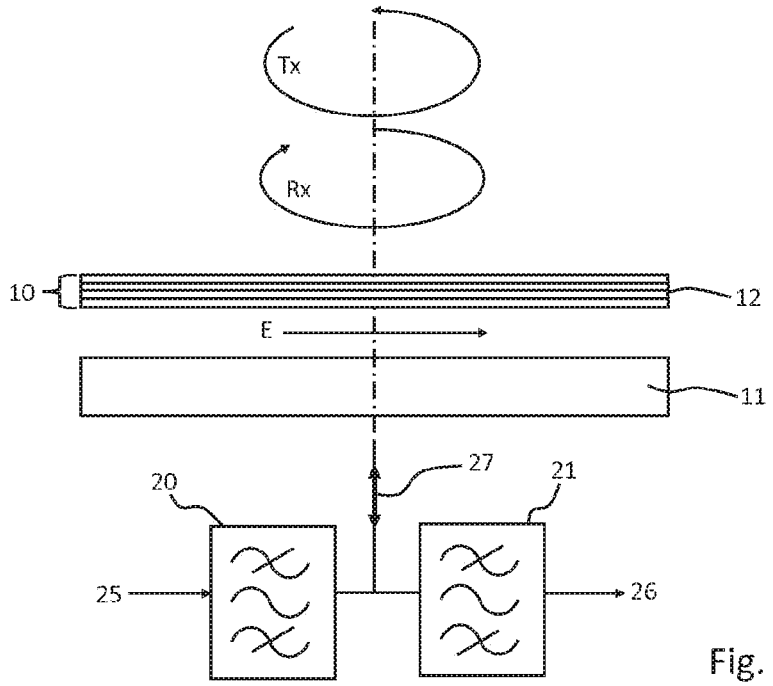
FIG. 1 illustrates a panel satellite telecommunications antenna equipped with a polarizer according to one embodiment of the invention.

FIG. 1 shows a panel satellite telecommunications antenna 11 covered with a polarizing device 10 comprising a plurality of frequency-selective layers 12 according to one embodiment of the invention. The satellite telecommunications antenna 11 is connected to a transmission channel 27 able to transmit information in both link directions. When the satellite telecommunications antenna 11 is used to emit, in the emission first frequency band Tx, the signal 25 to be emitted is applied to the input of the Tx filter 20 then transmitted to the antenna 11 via the transmission channel 27. When the antenna 11 is used to receive, in the reception second frequency band Rx, the satellite telecommunications antenna 11 captures a raw signal that is directed over the transmission channel 27 to the Rx filter 21 in order to be oriented toward the receiver 26. The Rx and Tx filters 21, 20, together form a diplexer.

A linear polarization E emitted by the antenna 11 may be decomposed into two linear components at ±45°: Ex and Ey. The polarizing device 10 is a free-space phase shifter allowing the components Ex and Ey of the linear polarization E of the antenna to be converted into a left-hand circular polarization or a right-hand circular polarization. The polarizing device generates a phase shift between the linear polarization Ex and the linear polarization Ey of between −85 and −95 degrees, and preferably of −90 degrees, in order to obtain the left-hand circular polarization, or a phase shift between the linear polarization Ex and the linear polarization Ey of between +85 and +95 degrees, and preferably of +90 degrees, in order to obtain the right-hand circular polarization On reception, a left- or right-hand circular polarization is converted into a linear polarization by the same principle in reverse. The right-hand reception and left-hand emission circular polarization directions may be inverted simply by physically turning the polarizing device by 90°, this having the effect of inverting the components Ex and Ey and therefore of inverting the sign of the 90° phase shift.

The polarizing device 10 comprises four frequency-selective layers 12 comprising an identical metal pattern allowing the desired phase shift to be obtained. As a variant, the polarizing device may include any number of frequency-selective layers 12 and their patterns may be different. Contrary to a conventional polarizing device in which a constant phase shift of 90° as a function of frequency is sought, the polarizing device of the invention tunes the circuits to obtain a phase shift of +90° in the reception frequency band Rx and a phase shift of −90° in the emission frequency band Tx. (or vice versa).

The susceptance B (imaginary part of the admittance) of each frequency-selective layer 12 is different for the components x and y, the differential phase shift Δφx/y is given by:

$$\Delta\varphi x/y = A\tan(Bx/2) - A\tan(By/2).$$

If the patterns are identical in each layer, the number of layers N to obtain a phase shift of 90° is therefore:

$$N = 90/\Delta\varphi x/y.$$

If the patterns of each layer are not identical, the sum of the differential phase shifts is about 90°.

Coupling of the assembly is obtained by separating the various frequency-selective layers 12 by about ¼ of a wavelength. In addition, to obtain a phase shift of 90° in the reception frequency band Rx and a phase shift of −90° in the emission frequency band Tx, it is necessary for the following equation to be respected:

$$\Delta\varphi x/yTx = -\Delta\varphi x/yRx.$$

Figure 2:
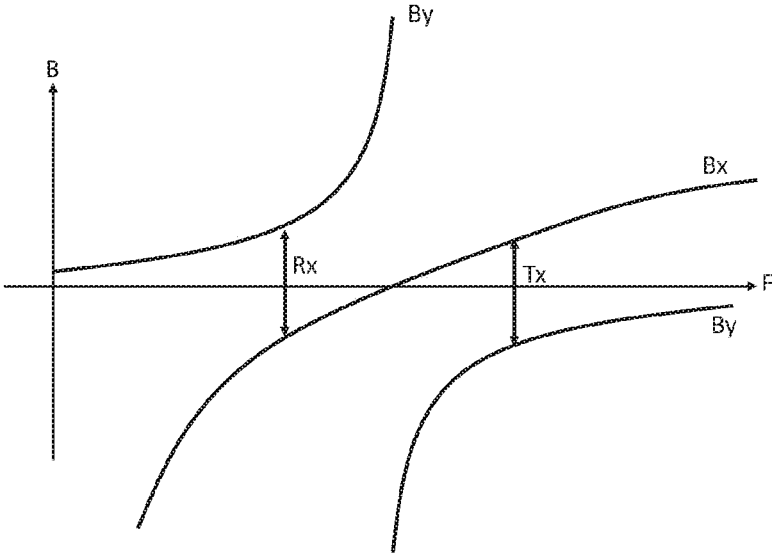
FIG. 2 illustrates a plot of the susceptances of a frequency-selective layer according to one embodiment of the invention.

A plot of the susceptances B used is shown in FIG. 2 as a function of frequency F. FIG. 2 shows a series resonance curve of the susceptance By for the component y and a parallel resonance curve of the susceptance Bx for the component x. As a variant, the series resonance may correspond to the component x and the parallel resonance may correspond to the component y.

In one exemplary embodiment, the series resonance of the susceptance By may correspond to the equation:

$$By = \frac{B_2}{\left(1 - \left(\frac{F}{F_0}\right)^2\right)}$$

and the parallel resonance of the susceptance Bx may correspond to the equation:

$$Bx = B_1\left(1 - \left(\frac{F}{F_0}\right)^2\right).$$

The equations of these susceptances Bx and By offer a possibility of adjusting the resonant frequencies F0 and the coefficients B1 and B2 in order to obtain the phase shift or the susceptances required for correct operation of the polarizing device 10. These equations also allow a stationary phase Δφx/y to be obtained in the two frequency bands Rx and Tx.

The components Bx and By of the susceptance are obtained with an identical pattern in four frequency-selective layers 12 the behavior of which is that of a parallel LC circuit for the component Ex and that of a series LC circuit for the component Ey, or vice versa. The pattern may take various forms allowing the shape and parameters of the phase shifts or susceptances to be adjusted.

Figure 3:
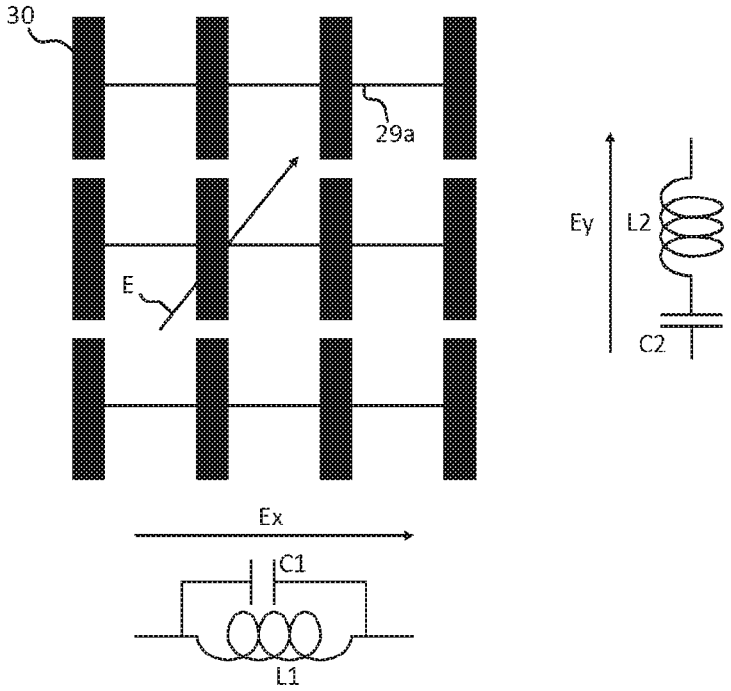
FIG. 3 illustrates a pattern of a frequency-selective layer according to a first embodiment.

FIG. 3 shows an example of a pattern implementable in the frequency-selective layers 12, said pattern consisting of an array of parallel horizontal continuous wires and an array of vertical dipoles; the pitch of this array is of the order of a half wavelength λ/2 i.e. about 5 mm at 30 GHz. The wires are formed by parallel lines and the dipoles are formed by solid rectangles 30 that are regularly spaced in columns and connected in their middle. The pattern in FIG. 3 makes it possible to obtain a component Ex having a behavior equivalent to a capacitor C1 in parallel with an inductor L1, and a component Ey having a behavior equivalent to an inductor L2 in series with a capacitor C2. Variants of this pattern provide additional degrees of freedom allowing the circuit to be adjusted with greater flexibility; the pitch is always about λ/2.

Figure 4:
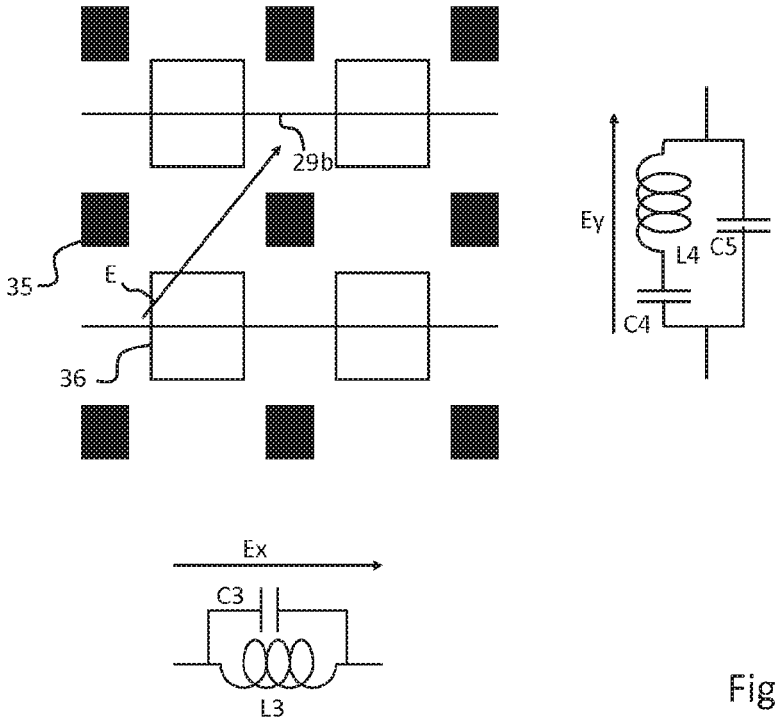
FIG. 4 illustrates a pattern of a frequency-selective layer according to a second embodiment.

For example, FIG. 4 shows a pattern implementable in a frequency-selective layer 12, said pattern consisting of parallel rows of solid squares 35 that are regularly spaced in columns. Between each group of four solid squares 35 empty squares 36 are placed, and between the parallel rows of solid squares 35 solid lines 29*b* are placed passing through the middle of the empty squares 36. The pattern in FIG. 4 makes it possible to obtain a component Ex having a behavior equivalent to a capacitor C3 in parallel with an inductor L3, and a component Ey having a behavior equivalent to an inductor L4 in series with a capacitor C4 together placed in parallel with a capacitor C5.

Figure 5:
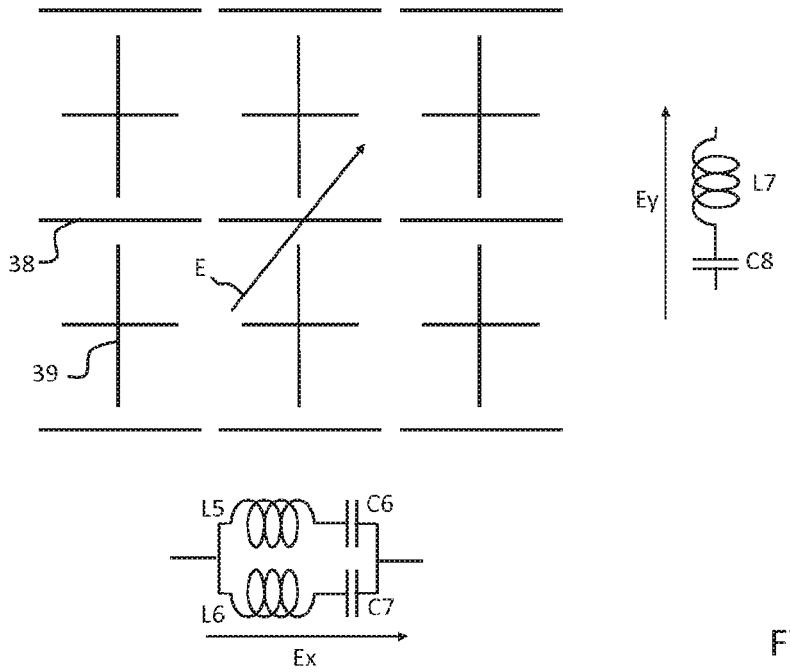
FIG. 5 illustrates a pattern of a frequency-selective layer according to a third embodiment.

To give another example, FIG. 5 shows a pattern implementable in a frequency-selective layer 12, said pattern consisting of parallel line segments 38. Between two parallel segments 38 are placed crosses 39 that are regularly spaced in columns. The pattern in FIG. 5 makes it possible to obtain a component Ex having a behavior equivalent to a capacitor C6 in series with an inductor C5 together mounted in parallel with an inductor L6 in series with a capacitor C7, and a component Ey having a behavior equivalent to an inductor L7 in series with a capacitor C8.

Figure 6:
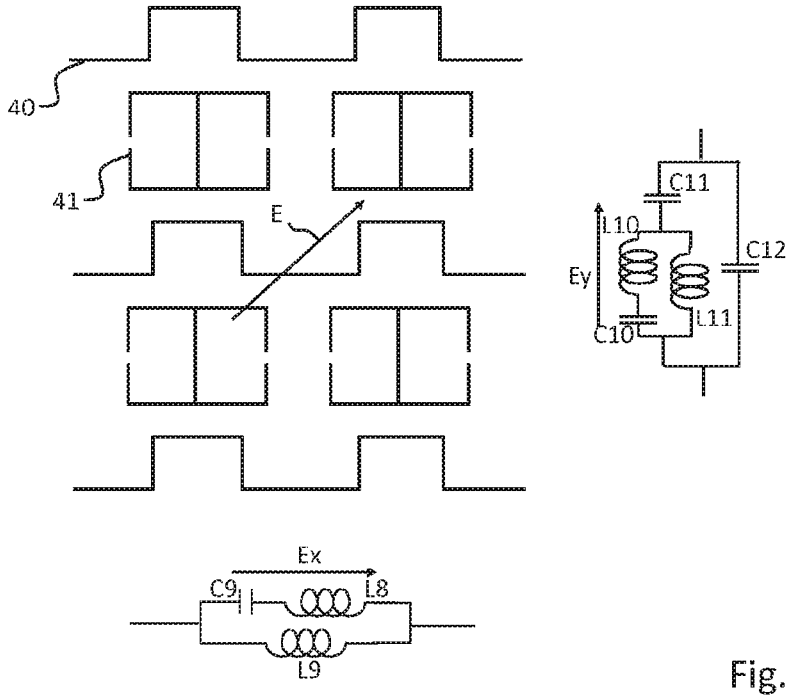
FIG. 6 illustrates a pattern of a frequency-selective layer according to a fourth embodiment.

According to another preferred embodiment, FIG. 6 shows a pattern implementable in a frequency-selective layer 12, said pattern consisting of snaking horizontal wires 40 that allow the value of the corresponding inductance to be adjusted in order to obtain a parallel resonance of satisfactory polarization selectivity along x, which wires are associated with double rectangular split-ring (double C) resonators 41 that give a series resonance of adequate polarization selectivity along y. The resonant frequencies and selectivity of the two resonances (series for polarization along y and parallel for polarization along x) allow the desired phase shift Δφx/y to be obtained in the two frequency bands Rx and Tx. Specifically, the pattern in FIG. 6 makes it possible to obtain a component Ex having a behavior equivalent to a capacitor C9 in series with an inductor L8 together mounted in parallel with an inductor L9, and a component Ey having a behavior equivalent to an inductor L10 in series with a capacitor C10 together mounted in parallel with an inductor L11, together mounted in series with a capacitor C11, together mounted in parallel with a capacitor C12.

During production of a polarizing device 10, it is recommended firstly to study the frequency of use of the antenna 11. For example, for a Ka-band satellite telecommunications (satcom) antenna, the following frequency bands are used:

reception frequency band Rx: from 17.7 to 20.2 GHz emission frequency band Tx: from 27.5 to 30 GHz The pattern of the frequency-selective layers 12 is then determined depending on the sought electrical behaviors. For example, the frequency selective layers 12 are produced on a printed circuit board the substrate of which is a RT/duroid 5880 laminate of 2 mm thickness and of relative dielectric constant $\varepsilon_r$=2.2.

The susceptances at the center of the reception frequency band Rx are: Bx=−0.4 and By=0.4. The susceptances at the center of the emission frequency band Tx are: Bx=0.4 and By=−0.4.

The differential phase shift of a layer is therefore:

$$\Delta\varphi x/y = 2A\tan(0.4/2) = 22.5°$$

The differential phase shift of a layer is therefore 22.5° in the emission frequency band Tx and −22.5° in the reception frequency band Rx.

If the polarizing device 10 includes four frequency-selective layers 12 separated by a spacing of λ/4 in the material, namely 2 mm, the total thickness of the polarizing device is therefore 6 mm.

Figure 7:
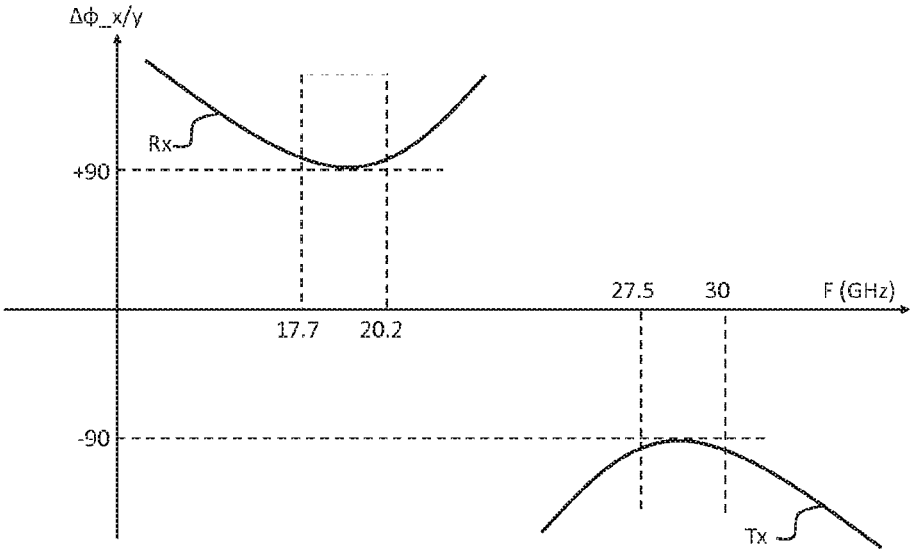
FIG. 7 illustrates a plot of the differential phase of a polarizing device including four frequency-selective layers for a satellite telecommunications antenna for the Ka band.

A plot of the differential phase Δφx/y of the complete polarizing device 10 is shown in FIG. 7 as a function of frequency F. The differential phase of the reception frequency band Rx is stationary and about +90°. Conversely, the differential phase of the emission frequency band Tx is stationary and about −90°.

Thus, this embodiment allows a phase shift close to +90° to be obtained in the reception frequency band Rx and a phase shift close to −90° to be obtained in the transmission frequency band Tx. As a variant, the number of layers may be decreased or increased depending on the performance desired in terms of coupling, axial ratio and incident angle operating range.

It is also possible to improve coupling by adding, on either side, one or more dielectric layers of different dielectric constants and of thicknesses equal to about one quarter of a wavelength in the material. For example, a layer having a dielectric constant of 1.5 and a thickness of about 2.5 mm may be placed at the entrance and exit.

The invention claimed is:

1. A polarizing device for a satellite telecommunications antenna, comprising:

at least one frequency-selective layer that converts a linear polarization into a left-handed circular polarization in an emission first frequency band and into a right-handed circular polarization in a reception second frequency band or vice versa, wherein:

the linear polarization comprises two components;

the phase shift between the two components of the linear polarization is −90 degrees in one of the frequency bands; and the phase shift between the two components-of the linear polarization is +90 degrees in the other of the frequency bands;

and said at least one frequency-selective layer comprises rows of snaking horizontal wires that are adjacent to and extend along rows of double rectangular split-ring resonators which are integrated to share a common side and are split on sides opposite the common side.

2. The device as claimed in claim 1, further comprising a plurality of frequency-selective layers possessing identical patterns.

3. The device as claimed in claim 1, wherein at least one frequency-selective layer is produced on a printed circuit board having a substrate thickness of 2 mm and a relative dielectric constant equal to 2.2.

4. The device as claimed in claim 1, further comprising four frequency-selective layers.

5. The device as claimed in claim 1, wherein the device has a susceptance (B) corresponding to the following equation:

$$B = \frac{B_2}{\left(1 - \left(\frac{F}{F_0}\right)^2\right)}$$

in which a characteristic ($B_2$) provides for adjusting the slope about a cut-off frequency ($F_0$) as a function of frequency (F).

6. The device as claimed in claim 1, wherein the device has a susceptance (B) corresponding to the following equation:

$$B = B_1\left(1 - \left(\frac{F}{F_0}\right)^2\right)$$

in which a characteristic ($B_1$) provides for adjusting the slope about a cut-off frequency ($F_0$) as a function of frequency (F).

7. The device as claimed in claim 1, further comprising at least one dielectric layer.

8. A satellite telecommunications antenna including a polarizing device as claimed in claim 1.

9. The antenna as claimed in claim 8, wherein the antenna is a panel antenna.

10. The device as claimed in claim 2, wherein at least one frequency-selective layer is produced on a printed circuit board having a substrate thickness of 2 mm and a relative dielectric constant equal to 2.2.

11. The device as claimed in claim 2, further comprising four frequency-selective layers.

12. The device as claimed in claim 3, further comprising four frequency-selective layers.

13. The device as claimed in claim 2, wherein the device has a susceptance (B) corresponding to the following equation:

$$B = \frac{B_2}{\left(1 - \left(\frac{F}{F_0}\right)^2\right)}$$

in which a characteristic ($B_2$) provides for adjusting the slope about a cut-off frequency ($F_0$) as a function of frequency (F).

14. The device as claimed in claim 3, wherein the device has a susceptance (B) corresponding to the following equation:

$$B = \frac{B_2}{\left(1 - \left(\frac{F}{F_0}\right)^2\right)}$$

in which a characteristic ($B_2$) provides for adjusting the slope about a cut-off frequency ($F_0$) as a function of frequency (F).

15. The device as claimed in claim 4, wherein the device has a susceptance (B) corresponding to the following equation:

$$B = \frac{B_2}{\left(1 - \left(\frac{F}{F_0}\right)^2\right)}$$

in which a characteristic ($B_2$) provides for adjusting the slope about a cut-off frequency ($F_0$) as a function of frequency (F).

16. The device as claimed in claim 2, wherein the device has a susceptance (B) corresponding to the following equation:

$$B = B_1\left(1 - \left(\frac{F}{F_0}\right)^2\right)$$

in which a characteristic ($B_1$) provides for adjusting the slope about a cut-off frequency ($F_0$) as a function of frequency (F).

17. The device as claimed in claim 3, wherein the device has a susceptance (B) corresponding to the following equation:

$$B = B_1\left(1 - \left(\frac{F}{F_0}\right)^2\right)$$

in which a characteristic ($B_1$) provides for adjusting the slope about a cut-off frequency ($F_0$) as a function of frequency (F).

18. The device as claimed in claim 4, wherein the device has a susceptance (B) corresponding to the following equation:

$$B = B_1\left(1 - \left(\frac{F}{F_0}\right)^2\right)$$

in which a characteristic ($B_1$) provides for adjusting the slope about a cut-off frequency ($F_0$) as a function of frequency (F).

* * * * *